United States Patent [19]

Gradecki et al.

[11] Patent Number: 4,697,710

[45] Date of Patent: Oct. 6, 1987

[54] CARPET DISPLAY STAND

[75] Inventors: Raymond J. Gradecki, Mundelean; James M. McLaughlin, Lake Zurich; Gerald R. Sorensen, Elgin, all of Ill.

[73] Assignee: NCM International, Inc., Arlington Heights, Ill.

[21] Appl. No.: 814,662

[22] Filed: Dec. 30, 1985

[51] Int. Cl.[4] ..... A47F 7/16

[52] U.S. Cl. ..... 211/45; 211/50

[58] Field of Search ..... 211/47, 49.1, 45, 169, 211/170, 50, 51, 41, 13

[56] References Cited

U.S. PATENT DOCUMENTS

| | | | |
|---|---|---|---|
| 2,804,212 | 8/1957 | Spitzig | 211/169 X |
| 2,913,843 | 11/1959 | Wittick | 211/45 |
| 2,964,198 | 12/1960 | Eisbart | 211/45 |
| 3,203,557 | 8/1965 | Ettlinger, Jr. | 211/41 X |
| 3,235,093 | 2/1966 | Eisbart et al. | 211/47 |
| 3,965,583 | 6/1976 | Price | 211/45 X |
| 4,193,652 | 3/1980 | Brown | 211/45 X |
| 4,232,791 | 11/1980 | Howard | 211/47 |

*Primary Examiner*—Ramon S. Britts
*Assistant Examiner*—Blair M. Johnson
*Attorney, Agent, or Firm*—Alan L. Barry; Amy L. H. Rockwell

[57] ABSTRACT

The carpet display stand of the present invention generally comprises a support assembly having at least four legs. The support assembly carries a basket deferred by vertical and horizontal framing pieces. The basket further includes a multitude of horizontal wires which have at least one depressed or U-shaped section connected with the vertical basket framing wires. A basket support wire joins the depressed section of the formed horizontal wires. The basket also includes a unique friction clip device formed from a plurality of evenyspaced, integrally-formed loop-shaped strutures. Adjacent clip devices define a slot between which corners of the carpet samples are downwardly inserted.

8 Claims, 7 Drawing Figures

CARPET DISPLAY STAND

TECHNICAL FIELD

The present invention generally relates to carpet display stands used for displaying carpet samples for either the wholesale or retail trade and in particular to a uniquely constructed "waterfall" or "cascade" type carpet display stand.

BACKGROUND OF THE INVENTION

Carpet display stands, particularly the "waterfall" or "cascade" type display stands, are a well-known tool of the carpet merchandising trade. Display stands of this type are utilized for the exhibit and promotion of carpets at either the wholesale or retail level of the trade.

Usually, display stands for this purpose have a support system which rests on the floor and a mechanism to retain the carpet samples in the stand. Prior art display stands are difficult to assemble and maintain since certain adaptations to the carpet samples are required. Some retaining mechanisms are clamps or screws which, to be effective, must have a compatible component, permanently attached to the samples, capable of joining with the clamp or screw. As a result of this requirement, some carpet samples cannot be displayed. Other samples having the required adaptation were marked or altered in such a manner as to distract the viewer. Still other samples were difficult to remove from the stand for comparison purposes with other samples on the same display stand or with samples on a separate display stand.

Another problem encountered with previous carpet display stands was the multitude of parts and the assembly of the carpet sample retaining mechanisms.

Yet another difficulty with previous carpet display stands was the limitation as to the size of carpet sample which could be retained.

One object of the present invention is to provide a carpet display stand which can accommodate various sizes of sample. For example, the preferred embodiment of the invention accommodates samples from approximately 14×18 inches in dimension to approximately 27×54 inches in dimension.

Another object of the invention is to provide friction clipping means which securely retain the carpet samples and yet allow for easy release and removal of such samples and yet eliminates special adaptation or alteration of the carpet samples. As previously discussed, in prior art display stands, display samples required a cut-out portion, a hole or other opening through the carpet sample in order to receive a hook or screw mechanism.

A further object of the present invention is to provide a stable carpet display stand which attractively displays a multitude of samples.

Other objects and advantages of the invention will become readily apparent as the specification proceeds to describe the invention with reference to the accompanying drawings.

SUMMARY OF THE INVENTION

According to the present invention, a new carpet display stand has been developed which can accommodate and retain a multitude of carpet samples for viewing, irrespective of sample size, yet allows easy release and removal of carpet samples. The present invention provides an easy-to-assemble display stand with an improved means to display evenly-spaced samples which can be easily viewed and compared by the customer. The display stand of the present invention retains and displays carpet samples by utilizing only a portion of one edge of the sample, thereby providing a larger surface area of the sample to be visible to the customer.

The carpet display stand of the present invention generally comprises a support assembly having at least four legs. The support assembly carries a basket deferred by vertical and horizontal framing pieces. The basket further includes a multitude of horizontal wires which have at least one depressed or U-shaped section connected with the vertical basket framing wires. A basket support wire joins the depressed section of the formed horizontal wires. The basket also includes a unique friction clip device formed from a plurality of evenly-spaced, integrally-formed loop-shaped structures. Adjacent clip devices define a slot between which corners of the carpet samples are downwardly inserted. With the friction clip devices of the present invention, no cutting or mutilation of the carpet display is necessary. Further, the friction clip devices are integrally formed into the basket and eliminate use of spring loaded clips or snaps which are subject to wear and eventual failure. Finally, in a preferred embodiment of the present invention, an extendable support rack may be engaged beneath the vertical framing pieces of the basket to provide an extended support surface for displaying carpet samples.

DETAILED DESCRIPTION OF THE INVENTION

Figure 1:
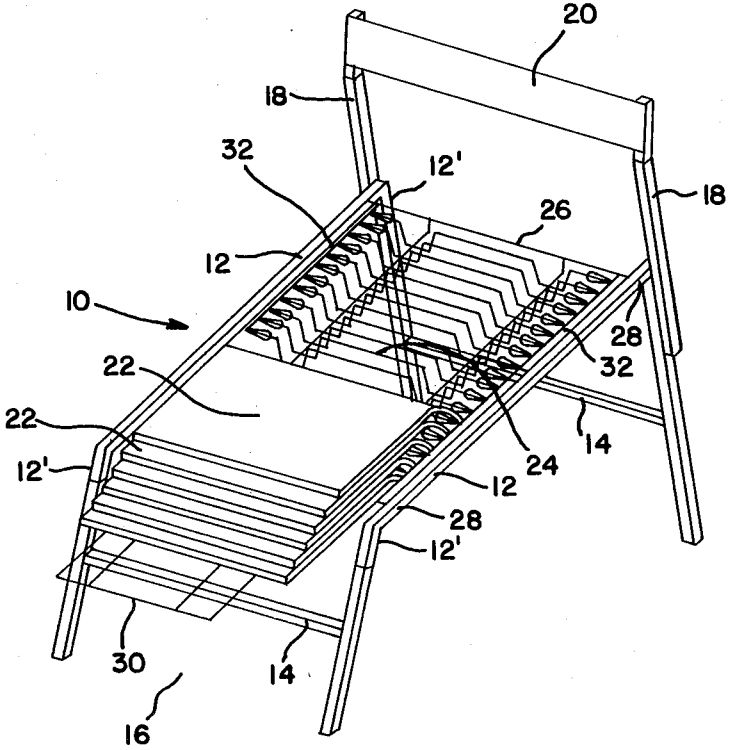
FIG. 1 is a perspective view of the display stand of the preferred embodiment of the invention disclosing carpet samples inserted at a lower end of the display.

Referring to the drawings, FIG. 1 discloses a display stand constructed in accordance with the present invention generally referenced by 10. Generally, display stand 10 is preferably manufactured from chrome plated tubular steel. Display stand 10 has a support assembly 12 having curved stand leg portions 12' connected to a front and rear H-shaped stand legs 14 which rest on the floor 16. Preferably, the H-shaped stand legs 14 are connected to curved stand leg portions 12' by self-locking fasteners such as locking nuts. Preferably, the rear H-shaped stand leg 14 is generally larger than the front H-shaped leg 14 in order to slant support assembly 12 forward.

Adjustably joined to an upper portion of the rear H-shaped stand leg 14 are header brackets 18 which support a header plate 20. The use of header plate 20 is optional and may be removed as may be required by the size and quantity of carpet samples 22 being retained by display stand 10. Header plate 20 can be used to display information concerning the identity and quality of the carpet samples 22 displayed.

Figure 2:
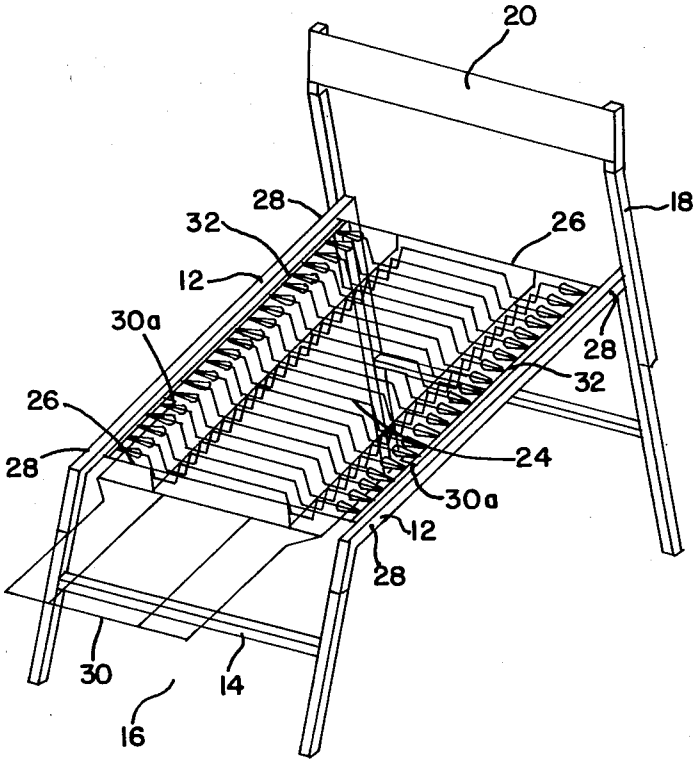
FIG. 2 is the same as FIG. 1 ommitting the retention of carpet samples.

Suspended within support assembly 12 is a basket 24 shown without carpet samples 22 in FIG. 2. Horizontal framing pieces 26 of the basket 24 are attached to the curved stand leg portions 12' with fasteners, preferably lock nuts 28. As disclosed in FIG. 2, a sample support rack 30, adjustable to a variety of positions, is attached by hooking free ends 30*a* of rack 30 underneath vertical framing piece 32 of the basket 24. Sample support rack 30 is extendable and adaptable to various positions along basket 24. Rack 30 assists in supporting carpet samples 22 which extend beyond the front portion of the basket 24, as shown in FIG. 3.

Figure 4:
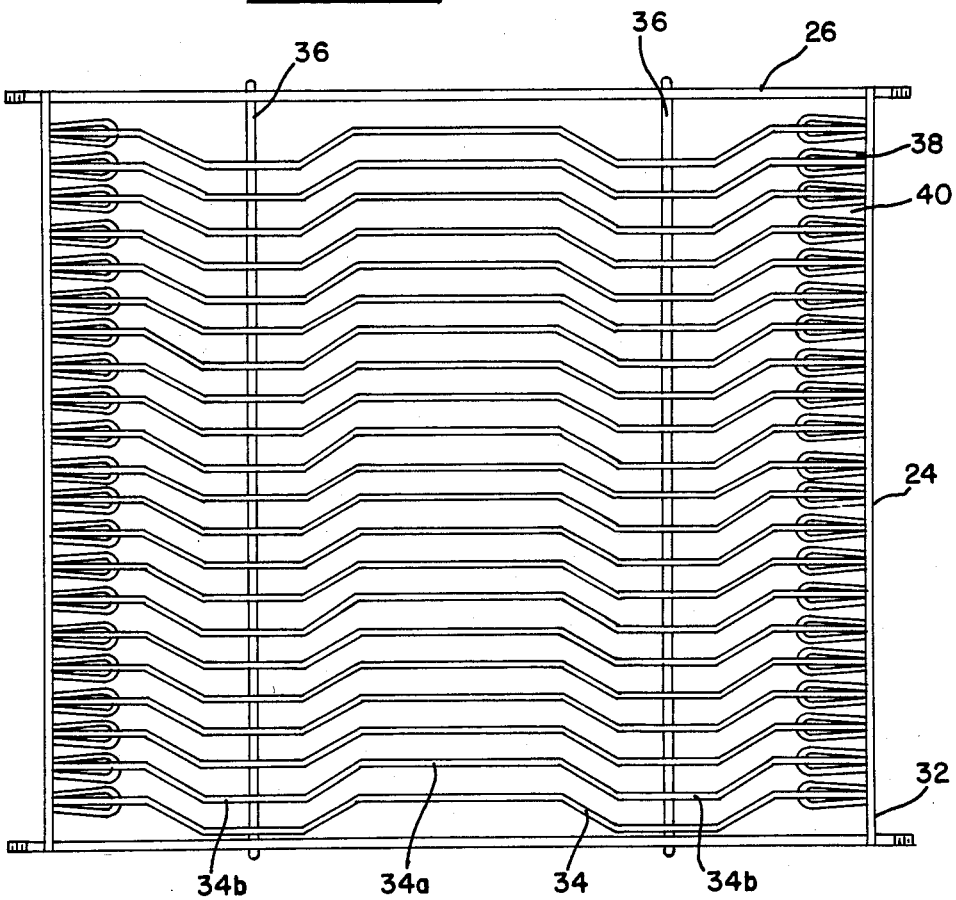
FIG. 4 is a plan view of a preferred basket element of the present invention.
Figure 5:
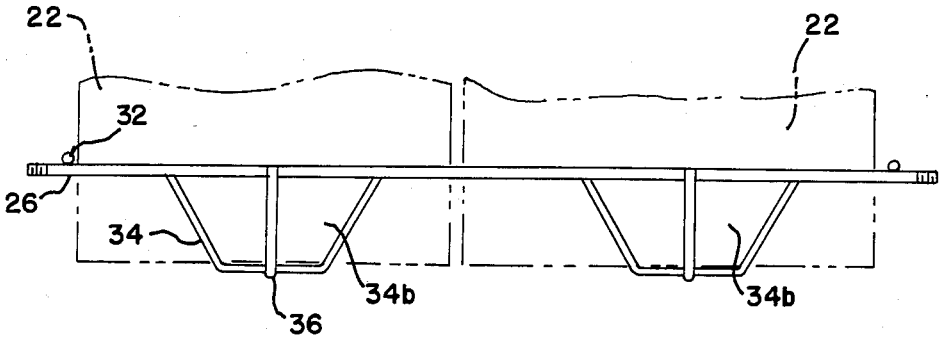
FIG. 5 is a front elevation view of the basket element disclosed in FIG. 4.

As shown in FIGS. 4 and 5, the basket 24 has a plurality of horizontal wires 34 selectively deformed to define a raised center section 34*a* with a depressed, generally U-shaped section 34*b* on either side. The elevated center sections 34*a* combine to effectively assist in supporting the carpet samples 22 which will be described later in greater detail. Each horizontal wire 34 is connected on each end to the vertical framing piece 32 and are evenly spaced apart. Preferably, at least two basket support wires 36 are connected on each end to the horizontal framing pieces 26. As best disclosed in FIGS. 5 and 6, support wires 36 extend upward to wrap about and define front and rear faces of basket 24. Likewise, FIG. 6 depicts wires 36 effectively providing basket 24 with a bottom, the function of which will be explained later.

Figure 6:
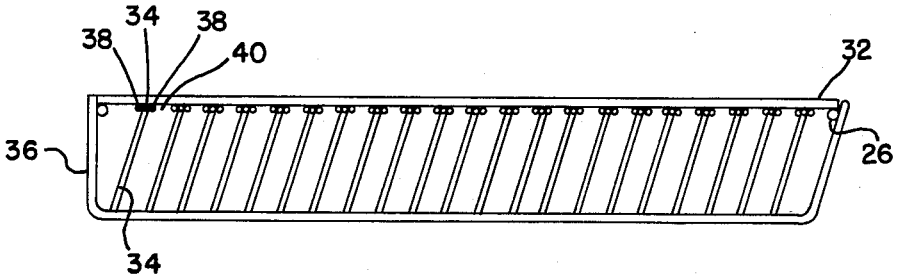
FIG. 6 is a side elevation of the basket element disclosed in FIG. 4; and, FIG. 7 is a fragmented, detailed view of a preferred embodiment of a friction clip means of the present invention.
Figure 7:
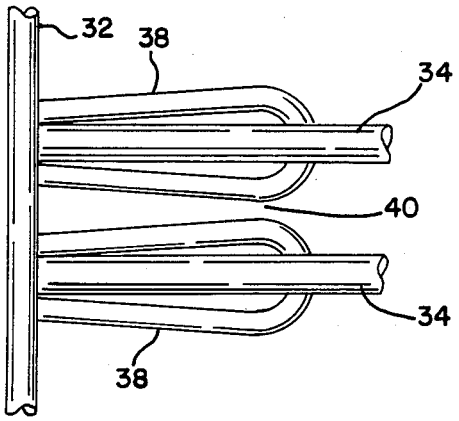

Further, wires 36 are centrally joined, preferably by spot-welding, to the base of the U-shaped sections 34*b* as disclosed in FIG. 6. Located immediately below each formed horizontal wire 34 and connected to the vertical framing pieces 32 is a friction clip 38. As disclosed in FIG. 7, the friction clip 38 is preferably loop-shaped with an open end connected to the vertical framing piece 32 so as to be integrally formed into basket 24. The friction clips 38 are spaced from one another, defining slots 40 between adjacent clips 38.

Figure 3:
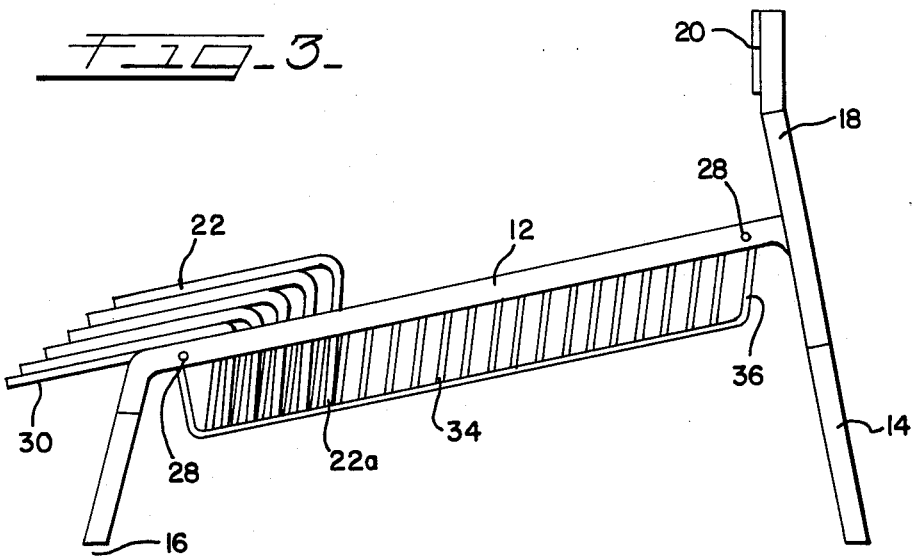
FIG. 3 is a side view of the display stand as shown in FIG. 1 having carpet samples attached to the lower portion of the stand.

As disclosed in FIG. 3, a corner of the carpet sample 22 which is to be displayed, is inserted downward into the slot 40 between two friction clips 38. For samples of a sufficient width, the adjacent corner of the sample is inserted in the slot 40 aligned across the basket 24 from the prior-inserted corner of the same sample. Irrespective of the width of the sample 22, the inserted corner or corners and the adjacent edge of the sample 22*a* are slid downward in the slot 40 until the inserted edge 22*a* of the carpet sample rests against basket support wires 36. Carpet samples which are narrower than the width of the basket 24 will have one corner inserted in the slot 40 and the opposing corner inserted between the corresponding formed horizontal wires 34. Another carpet sample can then be inserted in the slot 40 aligned across the basket 24 so that the samples are retained side by side. In this mode of use, raised center section 34*a* acts to prop the corners of adjacent samples 22 as disclosed in phantom in FIG. 5. Additionally, header plate 20 may be removed and the carpet samples may be allowed to drape over the back of the display stand 10.

While the specific embodiments have been illustrated and described, numerous modifications come to mind without significantly departing from the spirit of the invention, and the scope of protection is only limited by the scope of the accompanying claims.

We claim:

1. A carpet display stand for cascade display of carpet samples without penetration of the carpet samples through use of binder posts and fasteners, comprising:

a support assembly, the assembly having legs for supporting the stand;

a basket carried within the support assembly, the basket having two generally horizontal and two generally vertical framing members, a plurality of parallel wires extending between the vertical framing members, at least one portion of each wire being downwardly deformed to define a generally U-shaped section such that remaining portions of the wire define elevated sections relative to the U-shaped section, at least one support wire generally perpendicular to and spanning the parallel wires, the one support wire joining each parallel wire at a lowermost portion of the U-shaped section; and, means for frictional retention of one corner of a carpet sample, said frictional retention means being joined to the vertical framing members of the basket, each frictional retention means positioned immediately below each end of the parallel wires of the basket, adjacent frictional retention means defining a slot to receive a corner portion of the carpet sample.

2. The display stand described in claim 1, wherein said frictional retention means includes a plurality of loop-shaped members inwardly disposed with the basket, one end of the loop-shaped member joined to the vertical framing pieces of the basket, an other end of each loop-shaped member extended parallel with and bissected by one parallel wire of the basket.

3. The display stand described in claim 1 wherein the one support wire extends from one horizontal framing member to an other horizontal framing member.

4. A display stand for storage and cascade display of carpet samples without penetration of the carpet sample through use of binder posts and fasteners, comprising:

a stand support for elevating the stand from a floor surface;

a basket for storing and displaying the carpet samples, the basket being carried by the support assembly, the basket including, (a) a plurality of peripheral framing members, (b) a plurality of parallel wire members, the ends of the wire members spanning from one framing member to an other framing member, at least one portion of each parallel wire member being downwardly deformed relative to other portions of the wire member to define a generally U-shaped segment of the wire member, (c) at least one support wire member perpendicularly spanning all parallel wire members, the one support wire member joining each parallel wire member at a lowermost portion of the U-shaped segment; and, (d) a plurality of loop means being inwardly disposed within the basket and carried on at least the one framing member, at least one loop means positioned at an end of each parallel wire member, the loop means being selectively spaced apart to define a slot between two adjacent loop means for receiving and retaining a corner portion of the carpet sample.

5. The display stand described in claim 4 further comprising a support rack for support of carpet samples extending beyond the length of the basket, the rack adjustably joining the framing members of the basket.

6. The carpet display stand of claim 4 wherein the loop means further include a plurality of wire loop members joined along the length of at least the one framing member.

7. The carpet display stand of claim 6 wherein the wire loop members are close ended loops.

8. The carpet display of claim 4 wherein common portions of each parallel wire member are downwardly deformed to define a U-shaped segment.

* * * * *